US009850829B2

(12) United States Patent
Ito

(10) Patent No.: US 9,850,829 B2
(45) Date of Patent: Dec. 26, 2017

(54) CONTROL DEVICE AND CONTROL METHOD FOR INTERNAL COMBUSTION ENGINE

(75) Inventor: Masahiro Ito, Toyota (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 709 days.

(21) Appl. No.: 14/112,338

(22) PCT Filed: Apr. 17, 2012

(86) PCT No.: PCT/IB2012/000751
§ 371 (c)(1),
(2), (4) Date: Oct. 17, 2013

(87) PCT Pub. No.: WO2012/143773
PCT Pub. Date: Oct. 26, 2012

(65) Prior Publication Data

US 2014/0041627 A1 Feb. 13, 2014

(30) Foreign Application Priority Data

Apr. 19, 2011 (JP) ..... 2011-093178

(51) Int. Cl.
*F02D 31/00* (2006.01)
*F02D 41/08* (2006.01)
*F02D 41/14* (2006.01)

(52) U.S. Cl.
CPC ..... *F02D 31/001* (2013.01); *F02D 41/083* (2013.01); *F02D 41/086* (2013.01);
(Continued)

(58) Field of Classification Search
CPC .. F02D 31/001; F02D 41/083; F02D 41/1401; F02D 41/1497; F02D 41/086; F02D 41/08; F02D 41/14
USPC ..... 123/349, 351, 352, 353, 361, 370, 371, 123/376, 382, 389, 391, 403, 350, 339.19, 123/339.23
See application file for complete search history.

(56) References Cited

U.S. PATENT DOCUMENTS 4,406,262 A * 9/1983 Ikeura ..... F02D 31/005 123/339.17
4,671,235 A * 6/1987 Hosaka ..... B60K 31/107 123/352

(Continued)

FOREIGN PATENT DOCUMENTS

CN 1391635 A 1/2003
DE 69418611 T2 10/1999

(Continued)

*Primary Examiner* — Thomas Moulis
*Assistant Examiner* — John Bailey
(74) *Attorney, Agent, or Firm* — Sughrue Mion, PLLC

(57) ABSTRACT

An electronic control unit (100), which serves as a control device for an internal combustion engine, executes feedback control for controlling the torque of an internal combustion engine (10) so as to coincide the rate of decrease in engine rotational speed with a target rate of decrease in the engine rotational speed. The electronic control unit (100) calculates a required torque that is a torque required to keep the engine rotational speed at a constant rotational speed, and increases a feedback gain in the feedback control as the calculated required torque increases.

8 Claims, 3 Drawing Sheets

(52) U.S. Cl.
CPC ..... *F02D 41/1401* (2013.01); *F02D 41/1497* (2013.01); *F02D 2041/1409* (2013.01); *F02D 2041/1422* (2013.01); *F02D 2200/1012* (2013.01); *F02D 2200/602* (2013.01); *F02D 2250/18* (2013.01); *F02D 2250/26* (2013.01)

(56) References Cited

U.S. PATENT DOCUMENTS 4,681,075 A * 7/1987 Yamato ..... F02D 31/005 123/339.22
5,662,085 A * 9/1997 Aubourg ..... F02D 31/001 123/339.21
5,701,867 A * 12/1997 Mizutani ..... F02D 31/005 123/339.16
6,006,723 A * 12/1999 Akabori ..... F02D 41/083 123/339.17
6,109,236 A * 8/2000 Takahashi ..... F02D 31/003 123/339.19
6,289,873 B1 * 9/2001 Dunsworth ..... F02D 31/007 123/352
6,405,587 B1 * 6/2002 Livshiz ..... F02D 31/002 73/114.25
6,742,497 B1 * 6/2004 Kanamaru ..... F02D 31/002 123/339.11
6,990,953 B2 * 1/2006 Nakahara ..... F02D 11/105 123/339.16
8,515,645 B2 * 8/2013 Bucci ..... F02D 29/06 701/99
2002/0152989 A1 * 10/2002 Price ..... F02D 31/003 123/339.21
2004/0088103 A1 * 5/2004 Itow ..... B60K 6/485 701/110
2005/0257770 A1 * 11/2005 Nakahara ..... F02D 11/105 123/339.19
2006/0016441 A1 * 1/2006 Sakaguchi ..... F02D 41/0002 123/682
2007/0101708 A1 * 5/2007 Ohigashi ..... E02F 9/2235 60/431
2007/0192018 A1 * 8/2007 Gibson ..... F02D 13/04 701/110
2007/0299564 A1 * 12/2007 Nelson ..... G05B 15/02 701/1
2010/0186713 A1 * 7/2010 Kawaguchi ..... B60W 10/06 123/350
2011/0041802 A1 * 2/2011 Kar ..... F02D 31/003 123/352
2012/0303197 A1 11/2012 Seel

FOREIGN PATENT DOCUMENTS

DE 102009047618 A1 6/2011
JP 2000-073801 A 3/2000
JP 2003214231 A 7/2003
JP 2008-267329 A 11/2008
JP 2010007585 A 1/2010

* cited by examiner

CONTROL DEVICE AND CONTROL METHOD FOR INTERNAL COMBUSTION ENGINE

BACKGROUND OF THE INVENTION

1. Field of the Invention

The invention relates to a control device and control method for an internal combustion engine, which execute feedback control such that the rate of decrease in engine rotational speed coincides with a target rate of decrease.

2. Description of Related Art

There is known control over an internal combustion engine, in which, when accelerator operation is released, feedback control that executes feedback control over the rate of decrease in engine rotational speed so as to coincide with a target rate of decrease to thereby stabilize the behavior of a variation in engine rotational speed at the time when the engine rotational speed decreases with the release of accelerator operation.

In order to appropriately execute feedback control over the rate of decrease in engine rotational speed so as to coincide with the target rate of decrease, it is necessary to appropriately control the torque of the internal combustion engine on the basis of a deviation from the target rate of decrease. For this purpose, a feedback gain needs to be set at an appropriate value.

In contrast to this, Japanese Patent Application Publication No. 2000-073801 (JP 2000-073801 A) describes a control device for an internal combustion engine. When the engine rotational speed is likely to decrease, the control device increases the feedback gain as compared with when the engine rotational speed is not likely to decrease to thereby suppress a decrease in engine rotational speed.

The invention described in JP 2000-073801 A is to execute feedback control so as to coincide the engine rotational speed itself with a target engine rotational speed. Such a configuration that the feedback gain is increased when the engine rotational speed is likely to decrease as compared with when the engine rotational speed is not likely to decrease may be applied to feedback control.

Incidentally, the rate of decrease in engine rotational speed varies with an external load that acts on the output shaft of the internal combustion engine, so, even when the above configuration described in JP 2000-073801 A is applied to feedback control, an appropriate feedback gain cannot be set when an external load varies. Thus, it may be difficult to appropriately suppress a deviation of the rate of decrease.

Note that such a problem not only exists in feedback control during a period from when accelerator operation is released to when the engine rotational speed reaches an idle rotational speed but also it commonly exists in overall feedback control that executes feedback control over the torque of the internal combustion engine so as to coincide the rate of decrease in engine rotational speed with a target rate of decrease in the engine rotational speed.

SUMMARY OF THE INVENTION

The invention provides a control device and control method for an internal combustion engine, which are able to appropriately execute feedback control over the rate of decrease in engine rotational speed even when an external load varies.

A first aspect of the invention relates to a control device for an internal combustion engine, which includes a control unit that executes feedback control for controlling a torque of the internal combustion engine so as to coincide a rate of decrease in an engine rotational speed with a target rate of decrease in the engine rotational speed. The control unit calculates a required torque that is a torque required to keep the engine rotational speed at a constant rotational speed. The control unit increases a feedback gain in the feedback control as the calculated required torque increases.

The required torque is a torque require to compensate for a torque consumed by an internal load due to a friction load inside the internal combustion engine and an external load that acts on the internal combustion engine from an outside of the internal combustion engine to thereby keep the engine rotational speed at a constant rotational speed. Therefore, when the required torque is large, it is estimated that the torque consumed by the internal load and the external load is large, the engine rotational speed tends to decrease, and it is estimated that the rate of decrease in the engine rotational speed in the case of insufficient torque also increases.

In contrast to this, with the above described configuration, as the required torque increases, the feedback gain in the feedback control is increased. Therefore, when the torque consumed by the internal load and the external load is large and the rate of decrease in the engine rotational speed in the case of insufficient torque is high, the sensitivity of an increase or decrease in torque corrected through feedback control, is further increased. Thus, even when the external load varies, it is possible to set the appropriate feedback gain by which a variation in the rate of decrease in the engine rotational speed due to the variation of the external load may be suppressed.

That is, according to the above aspect, even when the external load varies, the rate of decrease in the engine rotational speed may be appropriately subjected to feedback control.

In the above aspect, the control unit may set a target rotational speed, at which the engine rotational speed is kept at constant, as the engine rotational speed that is acquired in order to calculate the required torque. In addition, the control unit may calculate the required torque on the basis of the set target rotational speed, an engine temperature, and an operating state of an auxiliary that is driven using an output of the internal combustion engine.

The viscosity of lubricating oil increases as the engine temperature decreases, so the internal load due to the friction load inside the internal combustion engine increases as the engine temperature decreases. Furthermore, as the engine rotational speed increases, the amounts of slide at the sliding portions of the components of the engine increase, so the amount of torque consumed by the internal load per unit time increases as the engine rotational speed increases.

In addition, the external load that acts on the internal combustion engine varies on the basis of the operating states of the auxiliaries driven using the output of the internal combustion engine. Specifically, the external load that acts on the internal combustion engine increases as the number of operated auxiliaries increases and as the driving amount of each operated auxiliary increases.

Therefore, by acquiring the set rotational speed, the engine temperature and the operating state of the auxiliary that is driven using an output of the internal combustion engine, it is possible to calculate the required torque that is a torque required to keep the engine rotational speed at the constant rotational speed.

That is, the engine rotational speed acquired at the time of calculating the required torque may be selectively set. In the above aspect, a torque required to keep the engine rotational speed at an idle rotational speed may be calculated as the required torque.

In the above aspect, calculation of the required torque may be executed in parallel with the feedback control.

In the above aspect, the feedback control may be integral feedback that integrates an update amount of rate of decrease calculated on the basis of a deviation between the target rate of decrease and an actual rate of decrease and the feedback gain to thereby calculate a torque correction amount.

In the above aspect, the control unit may control the torque correction amount such that the torque correction amount does not exceed a predetermined upper limit and a predetermined lower limit.

In the above aspect, when the torque correction amount is larger than the predetermined upper limit, the control unit may set the predetermined upper limit as the torque correction amount. When the torque correction amount is smaller than the predetermined lower limit, the control unit may set the predetermined lower limit as the torque correction amount.

In the above aspect, the control unit may execute the feedback control from when accelerator operation is released to when the engine rotational speed decreases to an idle rotational speed.

A second aspect of the invention relates to a control method for an internal combustion engine, which executes feedback control for controlling a torque of the internal combustion engine so as to coincide a rate of decrease in an engine rotational speed with a target rate of decrease in the engine rotational speed. The control method includes: calculating a required torque that is a torque required to keep the engine rotational speed at a constant rotational speed; and increasing a feedback gain in the feedback control as the calculated required torque increases.

With the above configuration, it is possible to stabilize the behavior of a variation in the engine rotational speed resulting from the release of accelerator operation by the time when the engine rotational speed reaches the idle rotational speed.

BRIEF DESCRIPTION OF THE DRAWINGS

Features, advantages, and technical and industrial significance of exemplary embodiments of the invention will be described below with reference to the accompanying drawings, in which like numerals denote like elements; and wherein.

DETAILED DESCRIPTION OF EMBODIMENTS

Hereinafter, an embodiment in which a control device for an internal combustion engine according to the aspect of the invention is applied to an electronic control unit 100 that comprehensively controls an internal combustion engine 10 mounted on a vehicle will be described with reference to FIG. 1 to FIG. 3.

Figure 1:
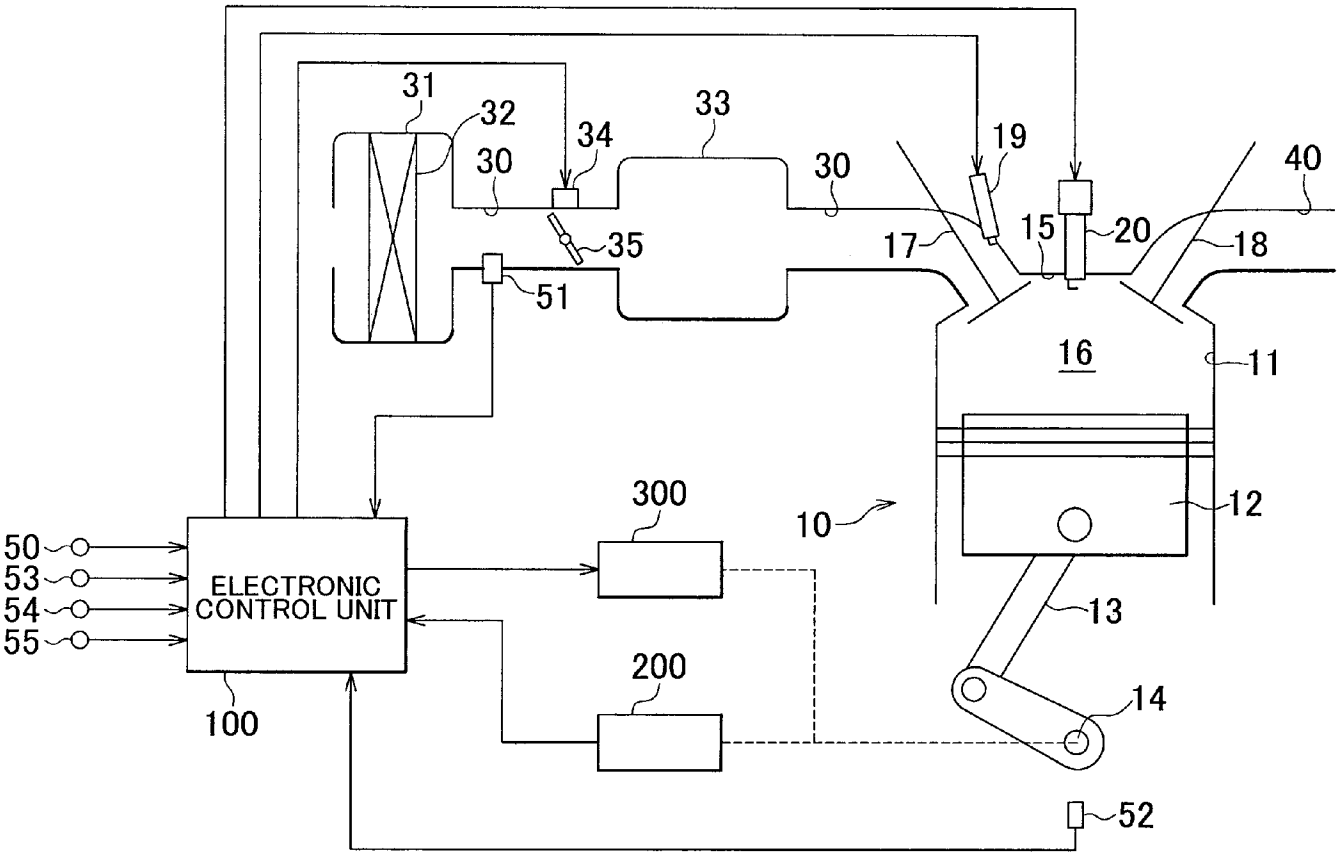
FIG. 1 is a schematic view that shows the relationship between an electronic control unit according to an embodiment of the invention and an internal combustion engine that is an object controlled by the electronic control unit.

As shown in FIG. 1, a piston 12 is slidably accommodated in a corresponding one of the cylinders 11 of the internal combustion engine 10. A crankshaft 14 is coupled to each piston 12 via a connecting rod 13. The crankshaft 14 is the output shaft of the internal combustion engine 10.

The pistons 12 are respectively accommodated in the corresponding cylinders 11 in this way to thereby define combustion chambers 16 by the inner peripheral surfaces of the cylinders 11, the top surfaces of the pistons 12 and the bottom surface of the cylinder head 15. Note that the internal combustion engine 10 is a multi-cylinder internal combustion engine having the plurality of cylinders 11; however, only one of the plurality of cylinders 11 is shown in FIG. 1.

Ignition plugs 20 are installed on the cylinder head 15 at positions facing the pistons 12 accommodated in the respective cylinders 11. Then, an intake passage 30 and an exhaust passage 40 are connected to each of the combustion chambers 16 respectively defined in the cylinders 11. In addition, as shown in FIG. 1, an injector 19 that injects fuel toward the corresponding combustion chamber 16 is provided in the intake passage 30 one by one for each cylinder 11.

As shown in FIG. 1, intake valves 17 and exhaust valves 18 are provided on the cylinder head 15. Each of the intake valves 17 opens or closes so as to provide or interrupt fluid communication between the intake passage 30 and the corresponding combustion chamber 16. Each of the exhaust valves 18 opens or closes so as to provide or interrupt fluid communication between the exhaust passage 40 and the corresponding combustion chamber 16. Note that the intake valves 17 are opened or closed by an intake camshaft coupled to the crankshaft 14 via a timing chain (not shown) and the exhaust valves 18 are opened or closed by an exhaust camshaft coupled to the crankshaft 14 via the timing chain.

As is shown at the left side in FIG. 1, an air cleaner 31 is provided at the most upstream portion of the intake passage 30. A filter 32 is provided inside the air cleaner 31. The filter 32 traps dust and dirt contained in intake air. By so doing, air from which dust and dirt are removed through the air cleaner 31 is introduced into the combustion chambers 16 of the internal combustion engine 10 via the intake passage 30.

A surge tank 33 is provided at a portion downstream of the air cleaner 31 in the intake passage 30. As shown in FIG. 1, the flow passage cross-sectional area of a portion at the surge tank 33 is larger than that of the other portion of the intake passage 30. By so doing, air introduced through the air cleaner 31 passes through the surge tank 33 to thereby equalize pulsation of air that passes through the intake passage 30.

In addition, as shown in FIG. 1, a throttle valve 35 is provided at a portion downstream of the air cleaner 31 and upstream of the surge tank 33 in the intake passage 30. The throttle valve 35 is driven by a motor 34, and the opening degree of the throttle valve 35, which is a throttle opening degree Th, is controlled.

Control over the opening degree of the throttle valve 35, fuel injection amount control for controlling the valve open duration Tf of each injector 19 and torque control executed through, for example, ignition timing control using the ignition plugs 20 are executed by the electronic control unit 100 that comprehensively controls the internal combustion engine 10.

The electronic control unit 100 includes a central processing unit (CPU), a read only memory (ROM), a random access memory (RAM), and the like. The CPU executes various processes in order to execute various controls regarding the torque control. The ROM stores computation programs, computation maps and various data. The RAM temporarily stores the results of computations, and the like.

Various sensors are connected to the electronic control unit 100. Various sensors include an accelerator position sensor 50, an air flow meter 51, a crank position sensor 52, a throttle position sensor 53, a coolant temperature sensor 54, a cam position sensor 55, and the like. The accelerator position sensor 50 detects an accelerator operation amount ACCP that indicates an amount by which an accelerator pedal is depressed by a driver. The air flow meter 51 detects the temperature Ta of air introduced into the intake passage 30 through the air cleaner 31 and an intake air mass GA that is the mass of the introduced air. The crank position sensor 52 detects the rotation angle of the crankshaft 14 per unit time. The throttle position sensor 53 detects a throttle opening degree Th that is the opening degree of the throttle valve 35. The coolant temperature sensor 54 detects an engine coolant temperature THW that is the temperature of engine coolant. The cam position sensor 55 detects the rotation angle of the intake camshaft. Then, the electronic control unit 100 calculates an engine rotational speed NE that indicates the rotational speed of the crankshaft 14 per unit time on the basis of the detected rotation angle of the crankshaft 14.

The electronic control unit 100 loads detected signals from these various sensors 50 to 55, and executes various controls associated with torque control. For example, the electronic control unit 100 calculates a required torque on the basis of the accelerator operation amount ACCP to change the throttle opening degree Th and controls the fuel injection amount and the ignition timing in the internal combustion engine 10 on the basis of the intake air mass GA detected by the air flow meter 51 to thereby generate torque appropriate to the required torque.

In addition, the electronic control unit 100 executes feedback control for controlling the torque of the internal combustion engine 10 so as to coincide the rate of decrease in the engine rotational speed NE from when depression of the accelerator pedal by the driver is released to when the engine rotational speed NE reaches an idle rotational speed with a target rate of decrease in the engine rotational speed. Note that, in this embodiment, a variation ΔNE that is a variation in the engine rotational speed NE per unit time is controlled so as to coincide with a target variation ΔNEtrg to thereby execute feedback control.

In this feedback control, the torque of the internal combustion engine 10 is increased or reduced on the basis of the operating states of auxiliaries, such as an air conditioner unit 200 and an alternator 300, that are driven using the driving force of the internal combustion engine 10. By so doing, the torque of the internal combustion engine 10 is controlled so as to suppress fluctuations in the variation ΔNE due to fluctuations in external load resulting from a variation in the operating states of the auxiliaries and to coincide the variation ΔNE with the target variation ΔNEtrg.

In order to execute such feedback control, various auxiliaries are connected to the electronic control unit 100 in addition to the various sensors 50 to 55 so as to be able to acquire the operating states of the various auxiliaries. For example, as indicated by the broken line in FIG. 1, the air conditioner unit 200 coupled to the crankshaft 14 is connected to the electronic control unit 100, and a signal that indicates whether the air conditioner unit 200 is operating is input to the electronic control unit 100.

Note that the air conditioner unit 200 is configured to reduce the external load that acts on the internal combustion engine 10 by releasing a clutch arranged between a compressor and the crankshaft 14 when the air conditioner unit 200 is not operating. Then, in the electronic control unit 100 according to the present embodiment, the external load that acts on the internal combustion engine 10 is estimated on the basis of whether the air conditioner unit 200 is operating. That is, when the air conditioner unit 200 is operating, the electronic control unit 100 estimates that at least the external load corresponding to the driving load of the air conditioner unit 200 acts on the internal combustion engine 10; whereas, when the air conditioner unit 200 is not operating, the electronic control unit 100 estimates that the external load corresponding to the driving load of the air conditioner unit 200 does not act on the internal combustion engine 10.

In addition, as indicated by the broken line in FIG. 1, the alternator 300 coupled to the crankshaft 14 is connected to the electronic control unit 100. The electronic control unit 100 adjusts the magnitude of field current supplied to the alternator 300 to thereby control the amount of electric power generated by the alternator 300. Therefore, large field current is supplied to the alternator 300, and, as the amount of electric power generated increases, the external load that acts on the internal combustion engine 10 increases. Then, the electronic control unit 100 estimates the external load due to the alternator 300 on the basis of the magnitude of field current supplied to the alternator 300. Specifically, the electronic control unit 100 estimates that the external load corresponding to the driving load of the alternator 300 increases as the field current increases.

In feedback control, the electronic control unit 100 corrects a basic torque set in order to achieve the target variation ΔNEtrg using a torque correction amount T that is calculated on the basis of the deviation D between an actual variation ΔNE and a target variation ΔNEtrg. By so doing, the electronic control unit 100 controls the torque of the internal combustion engine 10 so as to coincide the variation ΔNE with the target variation ΔNEtrg and to coincide the rate of decrease in the engine rotational speed NE with the target rate of decrease in the engine rotational speed. Note that the torque is varied by adjusting the throttle opening degree Th, adjusting the fuel injection amount, adjusting the ignition timing, or the like.

Hereinafter, the details of feedback control according to the present embodiment will be described with reference to FIG. 2 and FIG. 3. Initially, feedback control will be described with reference to FIG. 2 that shows the flow of a series of processes according to the feedback control. The routine shown in FIG. 2 is repeatedly executed at predetermined control intervals by the electronic control unit 100 when depression of the accelerator pedal is released during engine operation.

Figure 2:
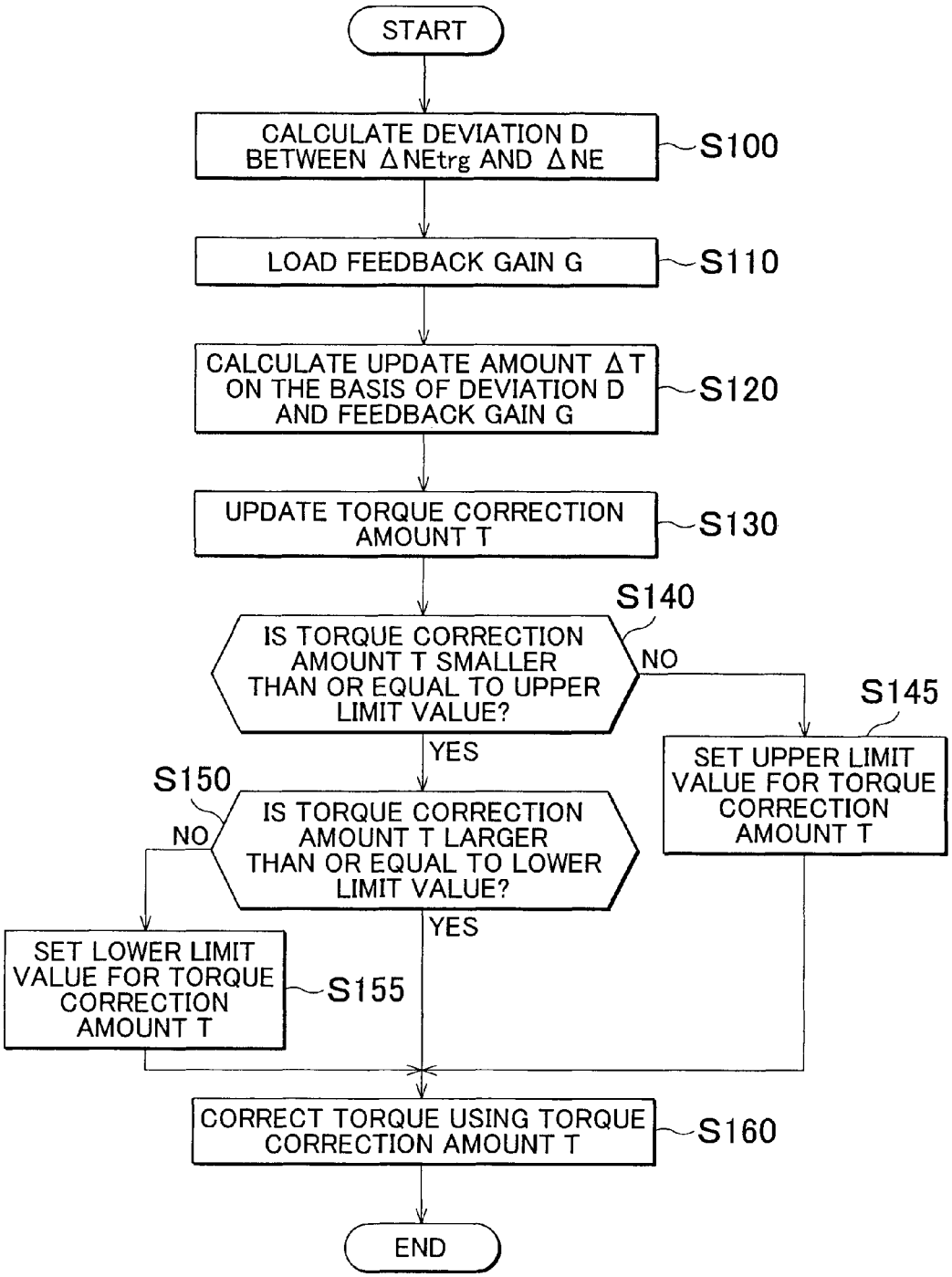
FIG. 2 is a flow chart that shows the flow of a series of processes in feedback control.

As the electronic control unit 100 starts the routine, the electronic control unit 100 initially calculates the deviation D between the target variation ΔNEtrg and the actual variation ΔNE of the engine rotational speed NE in step S100 as shown in FIG. 2. Note that, here, the target variation ΔNEtrg is subtracted from the variation ΔNE, and the absolute value of that difference is set as the deviation D. Then, the process proceeds to step S110, and a feedback gain G set through the processes shown in FIG. 3 is loaded. Note that a series of processes for setting the feedback gain G will be described later with reference to FIG. 3.

As the feedback gain G is loaded, the electronic control unit 100 calculates an update amount ΔT for the torque correction amount T on the basis of the deviation D and the feedback gain G in step S120. Specifically, the electronic control unit 100 multiplies the deviation D by the feedback gain G, and sets the product as the update amount ΔT.

As the update amount ΔT is thus calculated, the electronic control unit 100 updates the torque correction amount T in step S130. Specifically, the electronic control unit 100 adds the update amount ΔT to the torque correction amount T used in order to correct the torque in the last control interval to thereby update the torque correction amount T. Then, in step S140, the electronic control unit 100 determines whether the updated torque correction amount T is smaller than or equal to an upper limit value.

When it is determined in step S140 that the torque correction amount T is smaller than or equal to the upper limit value (YES in step S140), the process proceeds to step S150, and the electronic control unit 100 determines whether the torque correction amount T is larger than or equal to a lower limit value.

When it is determined in step S150 that the torque correction amount T is larger than or equal to the lower limit value (YES in step S150), the process proceeds to step S160, and the electronic control unit 100 corrects the torque using the torque correction amount T updated in step S130. Specifically, the electronic control unit 100 adds the torque correction amount T to a basic torque to calculate a target torque, and controls the torque so as to obtain the target torque to thereby correct the torque.

On the other hand, when it is determined in step S140 that the torque correction amount T is larger than an upper limit value (NO in step 140), the process proceeds to step S145, and the electronic control unit 100 sets the upper limit value as a new torque correction amount T. That is, the electronic control unit 100 sets the torque correction amount T at a value equal to the upper limit value. In this way, as the electronic control unit 100 sets the torque correction amount T at a value equal to the upper limit value, the process proceeds to step S160, and the electronic control unit 100 corrects the torque using the torque correction amount T.

In addition, when it is determined in step S150 that the torque correction amount T is smaller than a lower limit value (NO in step S150), the process proceeds to step S155, and the electronic control unit 100 sets the lower limit value as a new torque correction amount T. That is, the electronic control unit 100 sets the torque correction amount T at a value equal to the lower limit value. As the electronic control unit 100 sets the torque correction amount T at a value equal to the lower limit value, the process proceeds to step S160, and the electronic control unit 100 corrects the torque using the torque correction amount T.

That is, the feedback control according to the present embodiment provides an upper limit and a lower limit for the torque correction amount T to control the torque correction amount such that the torque correction amount T does not become a value larger than the upper limit value or a value smaller than the lower limit value.

Note that the feedback control according to the present embodiment sets the lower limit value at "0". That is, in the feedback control according to the present embodiment, the torque correction amount T is not set at a negative value.

As the torque is corrected using the thus set torque correction amount T, the electronic control unit 100 once ends the routine.

Next, the process of setting the feedback gain G used in the above feedback control will be described with reference to FIG. 3. The routine shown in FIG. 3, as well as the routine associated with the above described feedback control, is repeatedly executed at predetermined control intervals by the electronic control unit 100 when depression of the accelerator pedal is released during engine operation. The routine shown in FIG. 3 may be executed in parallel with the routine associated with the feedback control described with reference to FIG. 2.

Figure 3:
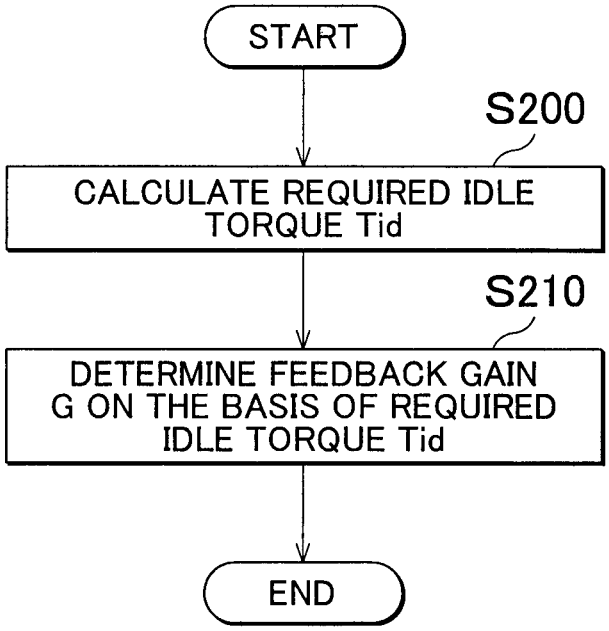
FIG. 3 is a flow chart that shows the flow of a series of processes for setting a feedback gain.

As the electronic control unit 100 starts the routine, the electronic control unit 100 initially calculates a required idle torque Tid in step S200 as shown in FIG. 3. The required idle torque Tid is a value that indicates a torque required to keep the engine rotational speed NE at the idle rotational speed. Here, the electronic control unit 100 calculates the required idle torque Tid in consideration of the internal load of the internal combustion engine 10 and the external load that acts on the internal combustion engine 10.

Specifically, the electronic control unit 100 initially acquires the engine coolant temperature THW as a value for estimating the engine temperature, and estimates the internal load of the internal combustion engine 10, that is, a friction load due to friction and the viscosity of lubricating oil. Then, the torque consumed by the internal load is estimated on the basis of the friction load and the engine rotational speed NE. In addition, the electronic control unit 100 calculates the torque required to drive various auxiliaries on the basis of the external load estimated on the basis of the operating states of the various auxiliaries, and adds the torque required to drive the auxiliaries to the torque consumed by the internal load to thereby calculate the required idle torque Tid.

As the electronic control unit 100 calculates the required idle torque Tid in this way, the process proceeds to step S210, and the electronic control unit 100 determines the feedback gain G on the basis of the calculated required idle torque Tid. Here, the electronic control unit 100 sets the feedback gain G at a larger value as the required idle torque Tid increases.

In this way, as the electronic control unit 100 sets the feedback gain G on the basis of the required idle torque Tid, the electronic control unit 100 once ends the routine.

The required idle torque Tid is a torque required to compensate for the torque consumed by the internal load due to the friction load inside the internal combustion engine and the external load that acts from the outside of the internal combustion engine 10 on the internal combustion engine 10 to thereby keep the engine rotational speed NE at the idle rotational speed. Therefore, when the required idle torque Tid is large, it is estimated that the torque consumed by the internal load and the external load is large, the engine rotational speed NE tends to decrease, and it is estimated that the rate of decrease in the engine rotational speed NE in the case of insufficient torque also increases.

In contrast to this, in the above embodiment, as the required idle torque Tid increases, the feedback gain G in feedback control is increased. Therefore, when the torque consumed by the internal load and the external load is large and the rate of decrease in the engine rotational speed NE in the case of insufficient torque is high, the sensitivity of an increase or decrease in torque corrected through feedback control is further increased.

According to the above described embodiment, the following advantageous effects may be obtained.

(1) In the above embodiment, as described above, the feedback gain G is increased as the required idle torque Tid increases, so, when the rate of decrease in the engine rotational speed NE in the case of insufficient torque increases, the sensitivity of feedback control is further increased. Thus, even when the external load varies, it is possible to set the appropriate feedback gain G by which a variation in the rate of decrease in the engine rotational speed NE due to the variation of the external load may be suppressed. That is, even when the external load varies, the rate of decrease in the engine rotational speed NE may be appropriately subjected to feedback control.

(2) The viscosity of lubricating oil increases as the engine temperature decreases, so the internal load due to the friction load inside the internal combustion engine increases as the engine temperature decreases. Furthermore, as the engine rotational speed NE increases, the amounts of slide at the sliding portions of the components of the engine increase, so the amount of torque consumed by the internal load per unit time increases as the engine rotational speed NE increases.

In addition, the external load that acts on the internal combustion engine 10 varies on the basis of the operating states of the auxiliaries driven using the output of the internal combustion engine 10. Specifically, the external load that acts on the internal combustion engine 10 increases as the number of operated auxiliaries increases and as the driving amount of each operated auxiliary increases.

Therefore, as in the case of the above embodiment, by acquiring the idle rotational speed, the engine coolant temperature THW and the operating states of the auxiliaries driven using the output of the internal combustion engine 10, it is possible to calculate the required idle torque Tid required to keep the engine rotational speed NE at the idle rotational speed.

(3) When the above described feedback control is executed, the behavior of a variation in the engine rotational speed NE resulting from the release of accelerator operation by the time when the engine rotational speed NE reaches the idle rotational speed may be stabilized.

(4) When the air conditioner unit 200 driven using the driving force of the internal combustion engine 10 is operating, the external load that acts on the internal combustion engine 10 increases by the amount of driving force required to drive the air conditioner unit 200. In contrast to this, in the above embodiment, the magnitude of the external load that acts on the internal combustion engine 10 is estimated on the basis of whether the air conditioner unit 200 is operating. Therefore, by acquiring whether the air conditioner unit 200 is operating, it is possible to estimate the magnitude of the external load that acts on the internal combustion engine 10.

(5) When a large field current is supplied to the alternator 300, the amount of electric power generated by the alternator 300 increases in comparison with when a small field current is supplied, so a driving force required to drive the alternator 300 also increases. In contrast to this, in the above embodiment, the magnitude of the external load that acts on the internal combustion engine 10 is estimated on the basis of the magnitude of field current supplied to the alternator 300. Therefore, by acquiring the magnitude of field current supplied to the alternator 300, it is possible to estimate the magnitude of the external load that acts on the internal combustion engine 10.

Note that the above described embodiment may be modified where appropriate or may be implemented in the following embodiments.

In the above described embodiment, the magnitude of the external load that acts on the internal combustion engine 10 on the basis of whether the air conditioner unit 200 is operating is estimated; instead, a method of estimating the magnitude of the external load that acts on the internal combustion engine 10 may be modified where appropriate.

For example, in the case of a control device for an internal combustion engine mounted on a vehicle equipped with an air conditioner unit having a variable displacement compressor, the magnitude of the external load may be estimated on the basis of the displacement of the compressor.

In addition, in the above described embodiment, the magnitude of the external load caused by the alternator 300 is estimated on the basis of the magnitude of field current supplied to the alternator 300. In contrast to this, in a control device for an internal combustion engine mounted on a vehicle equipped with a clutch between the crankshaft 14 and the alternator 300, the magnitude of the external load may be estimated on the basis of the engagement state of the clutch.

That is, in a vehicle that is equipped with a clutch and that engages or disengages the crankshaft 14 to or from the alternator 300, the magnitude of the external load that acts on the internal combustion engine 10 varies on the basis of the engagement state of the clutch. Therefore, it is applicable that the engagement state of the clutch is monitored, and then the magnitude of the external load is estimated on the basis of the engagement state of the clutch.

In addition, as the amount of electric power generated by the alternator 300 increases, the driving load of the alternator 300 increases. Therefore, it is also applicable that the amount of electric power generated by the alternator 300 is monitored and then the external load is estimated on the basis of the amount of electric power generated by the alternator 300.

Furthermore, when the amount of electric power generated by the alternator 300 is controlled on the basis of the magnitude of power consumption, the magnitude of power consumption may be monitored to estimate the external load on the basis of the magnitude of power consumption.

Note that the magnitude of power consumption varies on the basis of whether the light of a vehicle is lit up, whether an audio is used, or the like, so the magnitude of the external load may be estimated on the basis of whether the light of the vehicle is lit up, whether the audio is used, or the like.

The required idle torque Tid that is the torque required to keep the idle rotational speed is calculated as a required torque used as an index that indicates the rate of decrease in the engine rotational speed NE in the case of insufficient torque, and the feedback gain G is set on the basis of the required idle torque Tid. In contrast to this, when the torque required to keep the engine rotational speed NE at a constant rotational speed is calculated as a required torque, the rate of decrease in the engine rotational speed NE in the case of insufficient torque may be estimated on the basis of the required torque. Therefore, the required torque acquired at the time of calculating the feedback gain G is not limited to the required idle torque Tid. That is, the engine rotational speed NE acquired at the time of calculating the required torque may be selectively set. For example, it is applicable that the torque required to keep the engine rotational speed NE at 3000 rpm (revolutions per minute) higher than the idle rotational speed is calculated and the feedback gain G is set on the basis of the required torque.

In the above embodiment, feedback control is executed from when accelerator operation is released to when the engine rotational speed NE reaches the idle rotational speed; however, feedback control according to the aspect of the invention is not limited to such control that is executed when accelerator operation is not performed. That is, the aspect of the invention may be applied to feedback control for executing feedback control over the rate of decrease in the engine rotational speed NE when the accelerator operation amount ACCP is reduced.

In the above described embodiment, the aspect of the invention is illustrated as the electronic control unit 100 that controls the internal combustion engine 10 equipped with the throttle valve 35 and that adjusts the intake air mass GA by varying the throttle opening degree Th; however, the configuration for adjusting the intake air mass GA may be modified where appropriate. For example, it is applicable that a bypass passage that bypasses the throttle valve 35 provided in the intake passage 30 is provided and an idle speed control valve that is used to adjust the intake air mass GA is provided in the bypass passage. Then, the aspect of the invention may be applied to an internal combustion engine that varies the opening degree of the idle speed control valve to thereby increase or reduce the intake air mass GA while accelerator operation is released. With the above configuration, even when the throttle valve 35 is closed, the opening degree of the idle speed control valve is varied to thereby make it possible to adjust the intake air mass GA.

In addition, other than the above, the aspect of the invention may be, for example, applied to an internal combustion engine in which a mechanism for changing the lift and duration of each intake valve 17 is provided to adjust the intake air mass GA and the lift and duration of each intake valve 17 is changed to thereby adjust the intake air mass GA.

The engine temperature is estimated on the basis of the engine coolant temperature THW; instead, a method of detecting the engine temperature may be modified where appropriate. For example, it is applicable that the engine temperature is estimated on the basis of the temperature of lubricating oil instead of the engine coolant temperature THW or a sensor that directly detects the engine temperature is provided. In addition, it is also applicable that the engine temperature is estimated on the basis of the accumulated value of the intake air mass GA, or the like, which correlates with the combustion heat in the internal combustion engine 10.

The invention claimed is:

1. A control device for an internal combustion engine, comprising:

a control unit that executes feedback control for controlling a torque of the internal combustion engine so as to coincide a rate of decrease in an engine rotational speed with a target rate of decrease in the engine rotational speed, wherein the control unit calculates a required torque that is a torque required to keep the engine rotational speed at a constant rotational speed, the control unit increases a feedback gain in the feedback control as the calculated required torque increases, the control unit sets a target rotational speed, at which the engine rotational speed is kept constant, as the engine rotational speed that is acquired in order to calculate the required torque, and the control unit calculates the required torque on the basis of the set target rotational speed, an engine temperature, and a signal indicating an operating state of an auxiliary that is driven using an output of the internal combustion engine.

2. A control method for an internal combustion engine, which executes feedback control for controlling a torque of the internal combustion engine so as to coincide a rate of decrease in an engine rotational speed with a target rate of decrease in the engine rotational speed, comprising:

calculating a required torque that is a torque required to keep the engine rotational speed at a constant rotational speed; and increasing a feedback gain in the feedback control as the calculated required torque increases, wherein the calculating comprises setting a target rotational speed, at which the engine rotational speed is kept constant, as the engine rotational speed that is acquired in order to calculate the required torque, and the required torque is calculated on the basis of the set target rotational speed, an engine temperature, and a signal indicating an operating state of an auxiliary that is driven using an output of the internal combustion engine.

3. The control device according to claim 1, wherein a torque required to keep the engine rotational speed at an idle rotational speed is calculated as the required torque.

4. The control device according to claim 3, wherein calculation of the required torque is executed in parallel with the feedback control.

5. The control device according to claim 1, wherein the feedback control is integral feedback that integrates an update amount of rate of decrease calculated on the basis of a deviation between the target rate of decrease and an actual rate of decrease and the feedback gain to thereby calculate a torque correction amount.

6. The control device according to claim 5, wherein the control unit controls the torque correction amount such that the torque correction amount does not exceed a predetermined upper limit and a predetermined lower limit.

7. The control device according to claim 6, wherein:

when the torque correction amount is larger than the predetermined upper limit, the control unit sets the predetermined upper limit as the torque correction amount; and when the torque correction amount is smaller than the predetermined lower limit, the control unit sets the predetermined lower limit as the torque correction amount.

8. The control device according to claim 1, wherein the control unit executes the feedback control from when accelerator operation is released to when the engine rotational speed decreases to an idle rotational speed.

* * * * *